US007258299B2

(12) United States Patent
Carlsson

(10) Patent No.: US 7,258,299 B2
(45) Date of Patent: Aug. 21, 2007

(54) REEL WITH A SUPPORT SURFACE ARRANGED ON A FLEXIBLE ELEMENT AND A METHOD OF REGULATING THE DIAMETER

(75) Inventor: Allan Carlsson, Fagerås (SE)

(73) Assignee: Camatec Industriteknik Aktiebolag, Karlstad (SE)

( * ) Notice: Subject to any disclaimer, the term of this patent is extended or adjusted under 35 U.S.C. 154(b) by 2 days.

(21) Appl. No.: 10/536,783

(22) PCT Filed: Dec. 16, 2003

(86) PCT No.: PCT/SE03/01960

§ 371 (c)(1),
(2), (4) Date: May 27, 2005

(87) PCT Pub. No.: WO2004/054732

PCT Pub. Date: Jul. 1, 2004

(65) Prior Publication Data

US 2006/0011773 A1 Jan. 19, 2006

(30) Foreign Application Priority Data

Dec. 16, 2002 (SE) ..... 0203739

(51) Int. Cl.
*B65H 75/24* (2006.01)

(52) U.S. Cl. ..... 242/575.1

(58) Field of Classification Search ..... 242/575, 242/575.1, 575.2, 575.3, 575.4, 575.5; 188/218 R
See application file for complete search history.

(56) References Cited

U.S. PATENT DOCUMENTS 1,612,988 A * 1/1927 Ehrhold ..... 242/575.1
1,664,738 A * 4/1928 Deline ..... 493/382
3,075,720 A 1/1963 Theobald
4,953,806 A 9/1990 Rothenpieler

* cited by examiner

*Primary Examiner*—Patrick Mackey
*Assistant Examiner*—William E Dondero
(74) *Attorney, Agent, or Firm*—Jeffrey S. Melcher; Manelli Denison & Selter, PLLC

(57) ABSTRACT

A reel (1) for winding or unwinding reelable, strip-shaped objects such as steel strips, comprising a support surface (2) that extends in the main as a cylinder, a hub (8) arranged to rotate about an axis (4) in order to allow rotation of the support surface (2) about said axis (4), an adjusting device (60) arranged to cooperate with the support surface (2) in order thereby to vary the diameter (D1) of the support surface wherein the support surface (2) is arranged at a flexible element consisting of a continuous circumferential piece and that the adjusting device (60) is arranged to affect said support surface (2) to alter its shape, whereby the diameter (D) of the support surface can be varied.

18 Claims, 2 Drawing Sheets

REEL WITH A SUPPORT SURFACE ARRANGED ON A FLEXIBLE ELEMENT AND A METHOD OF REGULATING THE DIAMETER

TECHNICAL FIELD

The present invention relates to a reel to be used in the unwinding and winding of reelable, continuous objects. The reel is particularly suitable for the reeling of steel strips, but may also be used for the reeling of other metallic materials and materials such as paper, plastics and wood laminates. A reel according to the present invention may be suitable also in connection with the reeling of cables and other thread-like objects. A reel according to the invention is primarily intended to be used in applications in which the reelable objects can pass through some type of production process and in which new material is placed on a specific reel at regular intervals. Accordingly, the reel is not intended for applications in which the same material is unwinded from and winded onto the reel, such as e.g. a fishing type of reel.

A reel according to the invention comprises a support surface that extends in the main as a cylinder, a hub that is connected to the support surface in order to admit rotation of the support surface about an axis, an adjusting device that acts on the support surface in order thereby to vary the diameter of the support surface. The invention also relates to a method of using the reel in the unwinding and winding of reelable, strip-shaped objects.

PRIOR ART

It has been known for long to handle continuous objects such as strips and threads of metallic materials by winding them to form rolls, but also paper, paperboard, textiles, plastics, wood laminates and other materials may be handled in this way. Usually, several processing or treatment operations for the material are included in the production process, which means that the material must be handled in the works and easily be moved. At the start of such a production section, the material is unwound from a roll, is passed through the production section and at the end it is rewound to form a roll.

A device for winding or unwinding such objects is called a reel and there is a variety of different types of reels on the market. The diameter of the reel is increased and decreased, in order to be able to fasten or unfasten a roll, also called a bobbin. A supporting cylinder may be used inside the bobbin to support the material both during reeling and intermediate handling at the works. Such a cylinder is locked onto the outside of the reel, by expanding the diameter of the reel.

The inside supporting cylinders have a relatively low dimensional accuracy, which means that the reels must admit a certain variation in diameter. In most of today's reels, this is done by an advanced wedge system, with wedges that can be resembled by segments that together result in a circular cylindrical shape. The wedges are assembled about a shaft having an increasing diameter and the variation in diameter is obtained by a transversal displacement of the wedges along the shaft. Reels of this type often have relatively wide regulating ranges, which in this context corresponds to a diameter variation of about 100 mm. Examples of known devices according to the above are given in DE 2,659,344, FR 2,342,107 and U.S. Pat. No. 4,953,806.

Most of these reels have in common that they consist of a large number of moving parts, which means that they are relatively complicated to use as well as to maintain and repair. Due to the complexity of these known devices, they are relatively expensive to purchase, they have a limited life span and usually, they are large heavy pieces that are not easily moved, which means that many of them have a relatively limited field of use.

DE 3,119,868 presents another type of keel that has a more simple structure that the reels mentioned above. The reel consist of two shanks that are articulated joined in a central part in which there is also arranged a hydraulically actuated wedge. By a radial displacement of the wedge, the shanks are affected whereby the diameter of the reel is altered. This reel has a relatively limited regulating area.

BRIEF ACCOUNT OF THE INVENTION

It is an object of the present invention to eliminate or at least minimize the problems mentioned above. This is achieved by a reel comprising a support surface that extends in the main as a cylinder, a hub arranged to rotate about an axis in order to allow rotation of the support surface about said axis, an adjusting device arranged to cooperate with the support surface in order thereby to vary the diameter of the support surface. The reel is characterised by the support surface being arranged at a flexible element consisting of a continuous circumferential piece and that the adjusting device is arranged to affect said support surface to alter its shape, whereby the diameter of the support surface is varied.

Thanks to the invention, a reel is obtained that is considerably easier to handle than prior art reels. The reel consists of a few moving parts which contributes to a prolonged life span. By the number of moving parts being small, the advantage is also attained that the maintenance need is diminished, which makes the reel less costly to use. Moreover, the manufacturing of the reel can be less costly than for prior art devices. In case that the reel needs to be repaired, whereby it has to be replaced by a new one, a reel change can be performed in a very short time which is a very important production economical aspect of the invention. Repair of existing reels usually requires stoppage times of up to 8 hours, while an inventive reel only requires a stoppage time of between 20 min and 1 h, thanks to the possibility of easy reel replacement. The design of the reel also admits the same reel to be used for several purposes by a module system, which is another production economic advantage.

BRIEF DESCRIPTION OF THE DRAWINGS

In the following, the invention will be described in greater detail with reference to the attached drawing figures, of which.

DETAILED DESCRIPTION OF THE INVENTION

As mentioned in the introduction, a reel according to the invention is particularly suitable for the reeling of strip-shaped objects, e.g. steel strips. Steel strips are produced in widths of from a few mm and up to about 1 m and with thicknesses of from a few μm and up to several mm. The majority of the steel strips produced have widths within the range of 100-350 mm and the normal weight on a bobbin is within the range of 2.5-6 tonnes. In the following description, a reel is described that has a size intended to be used in the production of strips of such widths and thicknesses, but a reel according to the invention can of course also be manufactured in different sizes for different strip widths and loads.

Figure 1A:
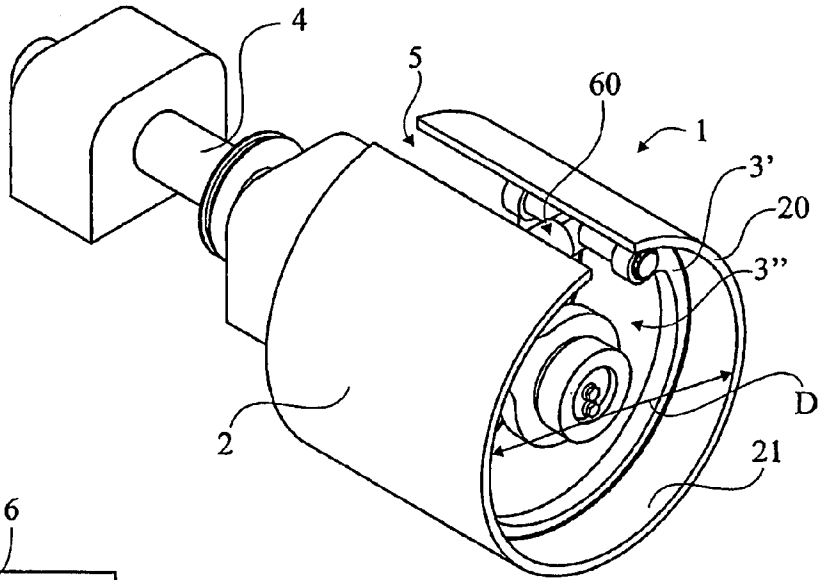
FIG. 1*a* illustrates a reel according to a preferred embodiment.
Figure 3:
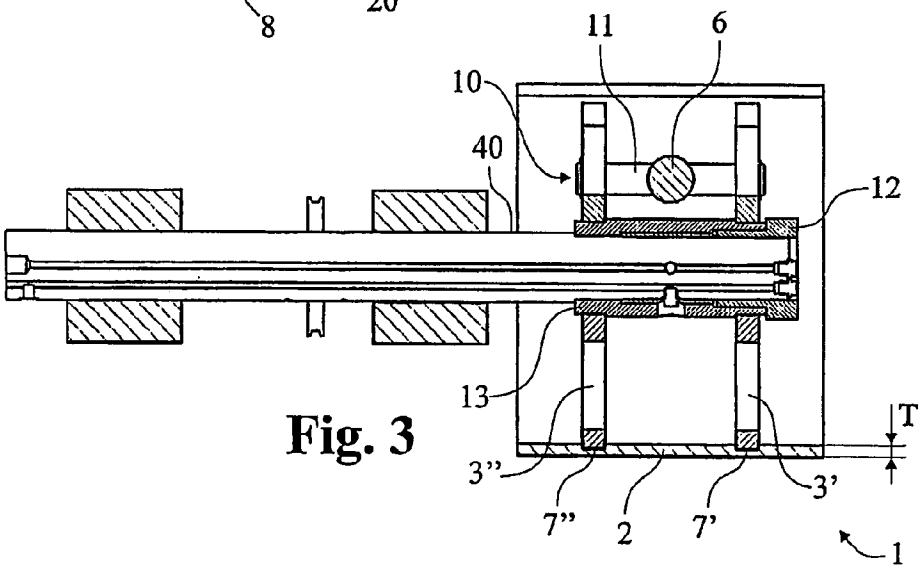
FIG. 3 illustrates an longitudinal section of a reel according to a preferred embodiment.

FIG. 1*a* shows a reel 1 according to a preferred embodiment. Just like other known devices, the reel is arranged to rotate about a geometrical axis 4. In a variant of the invention, the reel 1 may be arranged to rotate by a physical shaft 40 that is rotatably journalled in bearings. In this case, the reel 1 is fixedly attached to the physical shaft 40. In FIG. 3 it is indicated how the physical shaft 40 may be journalled in bearings and how the drive mechanism may be arranged. In another variant of the invention, the physical shaft 40 constitutes a stationary shaft about which the reel 1 is arranged to rotate. In this case, the reel 1 is journalled in bearings on the shaft 40 in order to rotate in relation to the same. Optionally, the reel 1 is provided with some type of brake. A reel of this type may only be used for uncoiling. It will not be described in detail how the reel is brought to rotate, since this is no essential feature of the invention.

The reel comprises a support surface 2 arranged at a flexible element 20 that consists of a continuous sheet sweep. The reel also comprises two support rings 3', 3", that are arranged at an inner surface 21 inside the flexible element 20 and essentially in parallel with the rotational direction of the reel, and an adjusting device 60 to adjust the diameter of the reel. One of the features of the embodiment is that the reel has an axial opening 5 that extends through the flexible element 20 and the support rings 3', 3". By affecting the flexible element 20 by a force from the adjusting device 60, it is possible to vary the diameter D of the support surface 2. The width of the opening 5 is determined primarily by the regulating range of the reel, i.e. its diameter variation D1–D2, and secondarily by the width of the hook of the travelling crane that is used to lift a bobbin. It should be understood that it is an advantage to limit the width b of the opening 5, as it contributes to the function and strength of the reel.

Figure 1B:
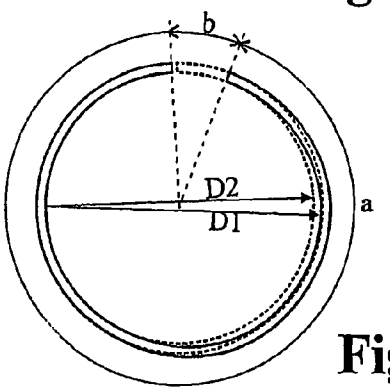
FIG. 1*b* diagrammatically illustrates a reel with denotations to calculate the extension of the opening.

In order for the diameter of the reel to be variable within the regulating range, it is a prerequisite that the opening 5 is given a minimal circumferential extension b. It is realised that the variation in diameter will mean that the support surface to some extent will lose its circularity, but an approximate expression to calculate the extension b of the opening 5 depending on the diameter variation (D1–D2) of the reel, can be obtained by the relation for calculation of the circumference (O=π D), where O is the circumference of the reel and D is the diameter of the reel, D1 is the largest diameter in the regulating range (maximally expanded reel) and D2 is the smallest diameter in the regulating range (maximally compressed reel), se FIG. 1*b*. At a maximally expanded reel, the circumference equals the total extension of the support surface a and the opening b, such that a+b=π×D1. When the reel is maximally compressed, the minimal circumference equals only the extension (a) of the support surface, such that a=π×D2. The minimal extension b of the opening 5, as seen along the circumference of said support surface 2 in relation to the diameter variation D1–D2 of the reel 1, can accordingly be calculated by the relation b=π(D1–D2).

For a reel having a regulating range where the outer diameter, i.e. the diameter on the outside of the support surface, is varied between 475 and 515 mm, preferably between 480 and 510 mm and even more preferred between 485 and 502 mm, the minimal extension b of the opening 5 can be calculated according to the following:

$$b=\check{\partial}(D1-D2)=>b=\check{\partial}(515-475);\ b=125\text{ mm}.$$

An opening of such length corresponds to an angle of about 28°.

FIG. 2*a* shows a side view of a reel 1 according to a preferred embodiment. In the Fig., the reel is oriented to have the opening 5 upwards directed. In addition to the opening 5 being a prerequisite in order for the diameter D of the reel to be varied, it also facilitates the operation of lifting on and off a bobbin onto/from the reel by the possibility to insert the hook of the travelling crane that the bobbin is suspended on, into the opening 5. The opening also enables a coiling reel in which the reel is provided with a strip nip that will be described further below.

In a beneficial embodiment, the flexible element 20 is manufactured from an elastic material. Different metallic materials, but also polymers, may be used. The choice of material is adapted to the load in question on the reel. The flexible element 20 is arranged with a pre-tension on the outside of the support rings 3', 3", which means that it is manufactured such that its diameter is somewhat smaller than the diameter of the support rings 3', 3" in a completely compressed position. At mounting, the flexible element 20 is somewhat pulled apart so that it is attached with spring action about the support rings 3', 3". Furthermore, the flexible element 20 is provided with grooves on the inside, in which the support rings are arranged to run, which is shown in greater detail in FIGS. 3 and 6. Accordingly, the flexible element 20 can move about the support rings 3', 3", in a circular direction.

Preferably, the support rings 3',3" are manufactured by casting, e.g. cast steel of the type SS 1581 or some other type with similar properties. Of course, other elastic materials can also be used, depending on field of application and load. In the Fig, only the front one of the two support rings is shown, here with the reference number 3'.

The main part of the support ring 3' is an elongated shank 9, but it may also be of an embodiment with two shanks, which is described below in connection with FIG. 4. In an advantageous embodiment, the support ring 3' comprises the hub 8 and preferably also a pair of engagement means (H, H') for attachment of a force exerting device 6. The hub 8, the shank 9 and the engagement means (H, H') are connected to each other and are preferably integrated with each other. The support ring 3' has an essentially circular shape with an opening 5' in its upper part. The support ring 3' has an extension in the circumferential direction that in an advantageous embodiment is shorter than the extension of the flexible element 20. When the reel is compressed, the flexible element 20 and the support ring 3' will move in relation to each other. The relative motion increases proportionally along the support ring 3', in a direction from the hub 8 and out to the end 90 of the shank, so that the end 90 of the shank gets nearer to the edge 50 of the support surface at the opening 5. The motion takes place by a slide between the flexible element 20 and the support ring 3'. It is advantageous to adapt the extension of the shank 9 of the support ring to allow the shank to be as long as possible without the support ring 3' for that matter projecting into the opening 5 at compression. This is achieved if the distance s from the end of the shank 90 to the edge 50 at the opening 5 of the support surface is essentially equal to the extension b as seen along the circumference of said support surface 2 in a completely expanded condition.

Accordingly, the major part of the support ring 3' is constituted by the elongated shank 9. The end 90 of the shank forms the second end of the support ring 3', which is provided with corresponding engagement means H' for attachment of the force exerting device 6. Both from a functional viewpoint and from a strength related viewpoint, it is advantageous if the engagement means H, H' are situated in close proximity to the ends of the support ring.

Accordingly, both ends 90, 91 of the support ring are connected to each other by a force exerting device 6, which in this case is constituted by a hydraulically actuated piston that is a standard component and does not constitute a part of the inventive idea. Thus, also other devices than hydraulic pistons are conceivable for this object. Use may be made for example of pneumatic pistons, jacks and mechanical tightening means such as wedges that are controlled manually or by machine.

Primarily, it is the support rings 3', 3" of the reel that have the task of carrying the load from a bobbin while the flexible element 20 contributes to distribute the load over the support rings.

The support ring 3' is characterised in that the hub 8, in connection with one end 91 of the support ring, is connected to the support ring 3', whereby the shank 9 gets an extension along the circumference of the support ring that is as long as possible. Hereby, a reel with a maximal variation in diameter is obtained. The hub 8 forms a ring that is designed to fit about the shaft 40. The shaft 8 is connected to the support ring 3' by a waist section 18. The waist section 18 is shaped to minimise stress concentrations. The shape of the waist section is also affected by the way that the force exerting device 6 is connected with the support ring 3' and of course, the waist section is dimensioned to resist the loads occurring both from the weight of a bobbin and from the load of the force exerting device 6. In the outer part of the waist section 18, engagement means is arranged, here in the form of a hole H, in which a shaft journal 10 is attached. The hole H is placed to get an adequate amount of material around the hole H in the support ring 3' and the waist section 18, so that no elastic deformation takes place in the material as the reel 1 is loaded. The shaft journal 10 is connected to the force exerting device 6, which thereby is connected to the hub 8. The engagement means may of course also be formed from other devices than holes, such as e.g. forks, grooves or articulations.

In FIG. 3, a longitudinal section of a reel 1 according to the preferred embodiment is shown, in which the reel is mounted on a shaft 4. The Fig. shows how the flexible element 20 is arranged on the outside of two support rings 3', 3", that run in grooves 7', 7" on the inside of the flexible element. The grooves 7', 7" are arranged in a plane that is in the main parallel with the direction of rotation of the reel. The Fig. also shows the force exerting device 6 that is symmetrically placed between the two support rings 3', 3" and is connected to both support rings via the shaft journal 10. Outside the shaft journal, there is a spacing tube 11. A sleeve 13 is arranged around the shaft 4, for attachment of the support rings 3', 3" around the shaft 4. The support rings 3', 3" are arranged at both ends of the sleeve 13 and are easily fitted by slipping the hub 8 of the respective support ring onto the sleeve from either direction, whereby the sleeve will run through the central hole of the hub. The sleeve has a shape that is adapted for the shaft and is locked onto the shaft by some type of locking device 12, such as a mechanical bushing, a cotter joint, a splined joint, a securing plate or a locking screw. Furthermore, it is possible to design at first hand an uncoiling reel to rotate about a stationary shaft, which means that the reel is not fixed onto the shaft. In this case, the reel is equipped with a bearing and means for controllable rotation about the shaft.

Is mentioned above, it is advantageous to design the reel such that the flexible element 20 is attached firmly around the support rings 3', 3" by a spring force. In order to achieve this, the flexible element 20 is designed to have a neutral layer, i.e. an unloaded position, at an inside diameter that is less than the outside diameter of the support rings as the support rings 3, 3' are positioned in their smallest diameter in the regulating range, suitable 2-10 mm smaller.

When regulating the diameter of the reel, the flexible element 20 is, via the support rings 3', 3", affected by the force from the force exerting device 6 by the force from the force exerting device 6 pressing apart or pulling together the support rings 3', 3". It is advantageous to give the flexible element 20 a shape that is as slim as possible, i.e. to minimise the thickness of material T to allow the flexible element 20 to follow the movements of the support rings without causing any plastic deformation in the material. In the preferred embodiment, the flexible element is manufactured from a steel of a quality called Weldox 700. For a reel having a regulating range according to the above, the thickness of material T can suitably be kept in a range in which 10 mm<T<20 mm, preferably 12 mm<T<18 mm and even more preferred 14 mm<T<16 mm.

The person skilled in the art will realise that a flexible element 20 having a larger thickness of material T will give rise to a larger flexural resistance which means that a greater force is required for the regulation of the diameter of the reel. It is also realised that the variation in diameter affects the thickness of material T of the flexible element such that a larger variation in diameter requires a flexible element 20 of thinner thickness of material in order to avoid plastic deformation of the material. It is of course also an important aspect that the flexible element 20 should distribute the load over the support rings and a certain thickness of material is required for that. It is also realised that a larger thickness of material will negatively affect the variation in diameter.

For a reel of the chosen size, it is suitable that the support surface is given an axial extension in a range of 370-430 nun, preferably 385-415 mm and most preferred about 400 m.

In the preferred embodiment it is an advantage if the neutral layers, i.e. the unloaded positions, of the flexible element 20 and the support rings 3', 3" are positioned at different diameters. Suitably, the flexible element 20 can have its neutral layer at a diameter that is somewhat smaller than the given smallest diameter of the reel 1 in the regulating range. In order to obtain a reel that has as wide a regulating range as possible, it is advantageous to provide the support rings 3', 3" with a neutral layer at a diameter in the middle of the regulating range. Hereby, the springing properties of the support rings are used both to decrease and to increase the diameter. When using the reel, it has proven to be an advantage to pre-tension the reel at a diameter as close to the neutral layer of the support rings as possible, as this has a positive effect on the life span of the reel. The person skilled in the art will however realise that in those cases in which a more narrow regulating range can be accepted, the neutral layer can be any one of the end positions of the regulating range. Of course, the invention comprises reels in which the diameter regulation takes place with a one direction spring motion, i.e. from a smallest or a largest diameter and back. Such a reel can be used e.g. if a more narrow diameter variation can be accepted.

It is characterising for the reel 1 in the preferred embodiment that the regulation of the diameter of the reel takes place under influence of the force exerting device 6, that causes an elastic deformation of the material in the flexible element 20 and the support rings 3', 3". As the force from the force exerting device 6 decreases, the material will spring back so that the support rings 3', 3" will strive to return to the unloaded position. This takes place both from expanded and compressed position. In the same way, the flexible element 20 strives to return to its unloaded position, why the spring force secures that the flexible element 20 follows the motion of the support rings 3', 3".

In the preferred embodiment, the flexible element 20 is pre-tensioned on top of the support rings 3', 3" and springs along with these at regulation of the diameter of the reel, without plastic deformation. A reel according to the invention is however not limited to the flexible element 20 being pre-tensioned, but the invention also comprises a non pre-tensioned flexible element.

Furthermore, it is an advantage that the flexible element 20 and the support rings 3', 3" are not fixedly connected to each other, but that regulation of the diameter of the reel takes place as a relative, circular motion between the flexible element 20 and the two support rings 3', 3" in order to avoid unnecessary stresses in the material.

The person skilled in the art will furthermore realise that since the variation in diameter is related to an elastic deformation of the material, the variation in diameter depends on the size of the reel. A small diameter reel has a more narrow regulating range than a larger diameter reel. It is furthermore realised that a small diameter reel in which the support ring is of a material with a low Young's modulus can have a wider regulating range than a larger diameter reel having a higher Young's modulus.

Figure 4:
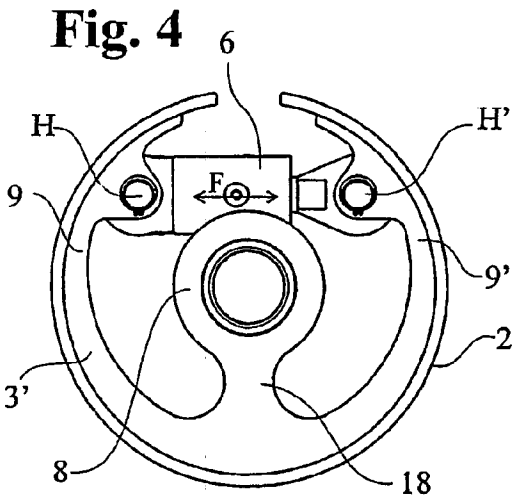
FIG. 4 illustrates a radial cross-section of a reel according to an alternative embodiment.

FIG. 4 shows a side view of a reel 1 according to an alternative embodiment, the difference being that the support ring 3' has been given a symmetrical shape. As the reel is freely suspended on the shaft, the support ring will be oriented such that the hub 8 and the waist section 18 points in the main vertically down and are surrounded by two shanks 9, 9' of essentially equal length on either side, that strive up along the inside of the flexible element 20. The force exerting device 6 is symmetrically connected to the shanks 9, 9' in close proximity to their upper ends, just like in the preferred embodiment. This embodiment will not admit as wide a regulating range as a reel according to the preferred embodiment in FIG. 2. It should be understood that the invention covers any optional positioning of the hub 8 along the circumferential extension of the support surface. The preferred embodiment has however proven to be best for the widest regulating range.

Figure 5:
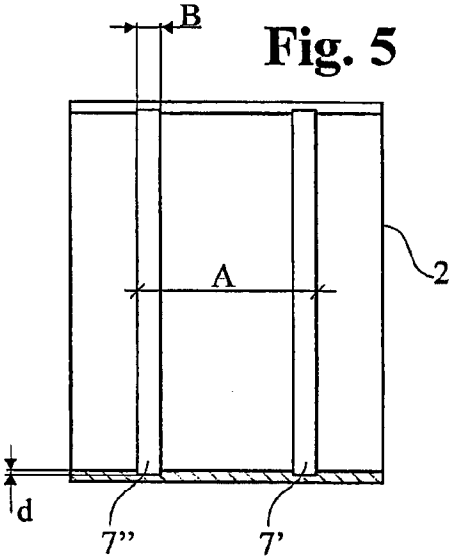
FIG. 5 illustrates a longitudinal section of a support surface.

FIG. 5 illustrates a longitudinal section of a flexible element 20, in which the two grooves 7', 7", in which the support rings 3', 3" are intended to run, are clearly shown. For a reel of the chosen size, the grooves suitably have a width B of 30-31 mm and a depth d of 5 mm. A symmetrical positioning of the two grooves 7', 7" for the support rings 3', 3" is advantageous, here with a relative distance A of about 230 mm measured from the outer edges of the grooves.

Thanks to the flexible element 20 being pre-tensioned to a diameter that is smaller than the smallest diameter of the support rings 3', 3", these grooves 7', 7" can run around the entire flexible element 20. This will give a manufacturing advantage by the flexible element 20 in a first position being composed of a circumferentially closed cylinder that is provided with the inside grooves 7', 7" by machining, where after the cylinder is axially cut up to form the opening 5 that is required to vary the diameter. The flexible element can also be manufactured from a tube blank, a shaped sheet, a cast tube or similar.

Figure 6:
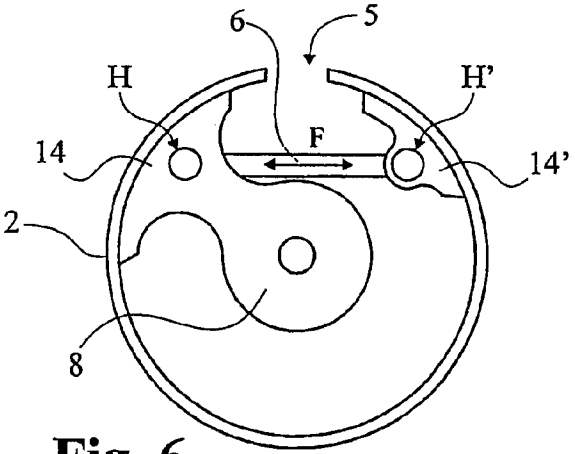
FIG. 6 illustrates a radial cross-section of an alternative embodiment.

FIG. 6 shows a side view of yet another embodiment in which the reel 1 lacks support rings 3', 3". In this variant, the flexible element 20 is a load carrier itself, which means that it must have a larger thickness of material. The force exerting device 6 is connected to the engagement means H, H', that are arranged in one segment 14, 14' each of a support ring, which segments are fixedly attached to the flexible element 20. This variant of the invention will result in a reel that, at a given size and for a given load, will have a more narrow regulating range for the diameter variation, than a reel according to the preferred embodiment.

The person skilled in the art will moreover realise that a reel 1 intended to be used in an application with small loads, not necessarily needs to be equipped with internal support rings. In such a case, the flexible element 20 can still be slim and a reel according to this embodiment can have a relatively wide regulation range.

Figure 7:
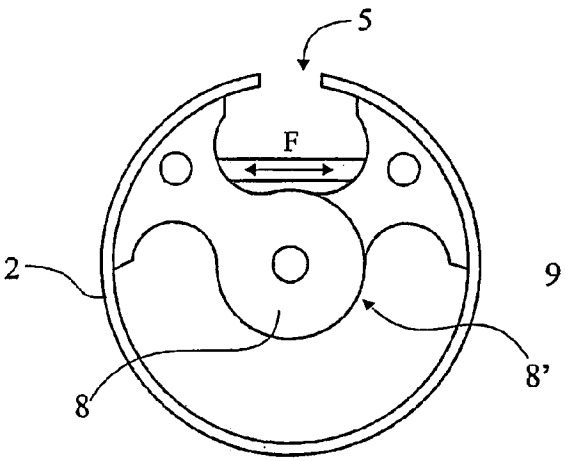
FIG. 7 illustrates a radial cross-section of an alternative embodiment.

FIG. 7 illustrates a side view of yet another alternative embodiment. This variant too lacks support rings 3', 3", why the flexible element 20 also in this case has been designed to be load carrying. This variant is provided with two hubs 8, 8' that are connected to the flexible element 20 on either side of its opening 5. The diameter variation is achieved by a force exerting device 6 that is connected to the hubs in the same way as is described above.

Figure 8:
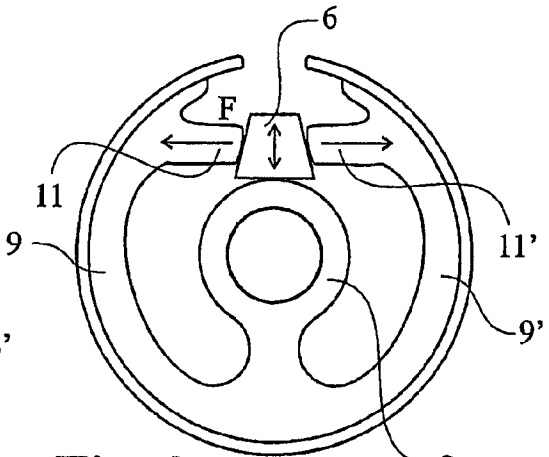
FIG. 8 illustrates a radial cross-section of an alternative embodiment.

FIG. 8 shows yet another side view of an alternative embodiment in which the force exerting device 6 consist of a manoeuvrable wedge that is radially displaceable. The wedge cooperates with the engagement means 11, 11', whereby the two shanks 9, 9' will be affected to enable varying of the diameter of the support surface 2. Optionally, the wedge 6 may be provided with grooves in which the engagement means run. Hereby, the reel can also be compressed from a neutral layer of the support ring 3'.

Figure 9:
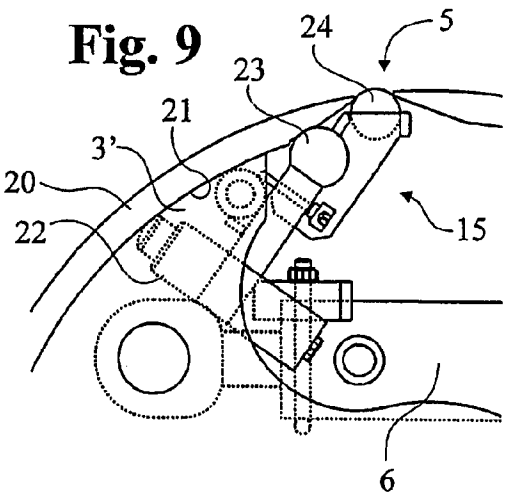
FIG. 9 illustrates a nip for a strip.

At coiling of thin materials, the material is most easily taped onto the support surface or onto an attached support ring. Thicker materials will however require a stronger attachment and for this purpose the reel can be provided with a strip nip 15, shown in FIG. 9. The strip nip 15 is mounted on the inside of the flexible element 20, between the two support rings 3', 3", in connection with the opening 5, and operates by lever action by a resilient device 22. When the reel is compressed, the strip nip 15 will be affected by the force exerting device 6, to create a slit between the inner surface 21 of the flexible element and a rod 23 in the strip nip 15 that runs axially along the opening 5 where the material can be inserted. As the reel 1 is then expanded, the influence from the force exerting device 6 on the strip nip 15, ends, whereby the strip nip springs back to lock the strip between the inner surface 21 of the flexible element and the longitudinal rod. In addition, the strip nip comprises a rounded rod 24 that is axially positioned in the opening 5, the function of which is to form a smooth transition between the support surface 2 and the strip nip 15 in order to avoid that the coiled material is bent over the edge of the support surface. It is an advantage that the flexible element 20 is fixedly attached to the support ring 3' in connection with the end at which the strip nip 15 is arranged, in order not to risk that the flexible element 20 is bent up by the force that the strip exerts at winding.

ALTERNATIVE EMBODIMENTS

The invention is not limited to that described above but may be varied within the scope of the claims. It is for example realised that the number of support rings, preferably being at least two, can be varied depending on the axial extension of the reel, and it is realised that narrow reels can cope with a single support ring while wider reels can be provided with up to 4-6 support rings. Furthermore, it is conceivable to design the support rings to have an essentially axial extension and to decrease the radial extension, i.e. the thickness, whereby two support rings can be replaced with something that can be resembled by another flexible element. Then, the reel will comprise an outer flexible element 20, at which the support surface 2 is arranged, and an inner flexible element that replaces the support rings. The inner and the outer flexible elements should of course be mutually moveable in a circular direction in the same way as in the case that support rings are used.

It is conceivable to design the flexible element 20 with its neutral layer in an optional position within the regulating range, which could mean that the neutral layer of the flexible element coincides with the neutral layers of the support rings 3', 3". In such a variant of the device, the support surface 2 is provided with some type of shoulders or stop means (not shown) at the ends of the grooves 7', 7", that have the function of pulling the support surface 2 along with them when the diameter is to be regulated to be smaller than the diameter that constitutes the neutral layer of the support surface 2.

The inventive idea also comprises reels in which the opening 5 is relatively narrow. The support surface 2 and the flexible element 20 are given such a circular extension that one end 50 of the flexible element 20 will overlap the opposite end on the other side of the opening 5 when the reel is compressed.

In works where it is not required that the material is wound up on an internal support cylinder, it is conceivable to use coiling reels having a more narrow range of diameter variation. Then, it is easiest to exert the reel in its fully expanded position, where after the material is wound up. As the winding up is finished, the reel is compressed in order for the bobbin to be able to be removed.

The design of the reel contributes to that one and the same reel can be used for several purposes. By a module system, an uncoiling reel can easily be complemented to function as a coiling reel, by providing the flexible element 20 with a strip nip 15 according to the above. Furthermore, the sleeve 13 can be given a symmetrical internal shape, whereby one and the same reel can be used both as a right-hung and as a left-hung reel (primarily related to coiling reels).

The module system also comprises the possibility to use different widths of support surfaces 2. Hereby, it is easy to adapt the reel to materials of different widths. It is also conceivable to use hubs having several interconnected support rings to give an increased axial extension.

The inventive idea also comprises to provide existing reels with a flexible element in order to obtain a reel having a continuous support surface. The flexible element can be placed with spring action outside the wedges or similar devices that in the original design compose the support surface upon which an internal bobbin support ring is placed. In this way, existing reels can also be used without requiring internal support rings for the bobbin.

USE OF THE REEL

The invention also comprises a method to regulate the diameter of the reel. The starting position for regulating the diameter of the reel 1 is a neutral layer in which the support ring 3' of the reel is unloaded, i.e. no forces act upon it. From this position, the reel can either be compressed or expanded in order to change its diameter. The total regulating range is defined by the two end positions for compression and expansion, respectively. The method is characterised in that the adjusting device 6, by force action, causes a change in the shape of the support surface 2 by an elastic deformation of the material in the flexible element 20 and the support rings 3', 3".

The design of the support ring 3' leads to that it does not appreciably change in shape in the section at the hub 8, but that the elastic deformation arises in the elongated shank 9. This contributes to an increased life span and gives a number of operational advantages. For example, the inherent spring force of the material is used for regulation, which contributes to a decreased energy demand. Another advantage is also attained by the fact that if a breakdown would occur and one wants to remove a bobbin from the reel, the reel will spring back to its unloaded position as soon as the regulating force decreases/the mechanical unit is removed, which is an important security aspect.

Figure 2:
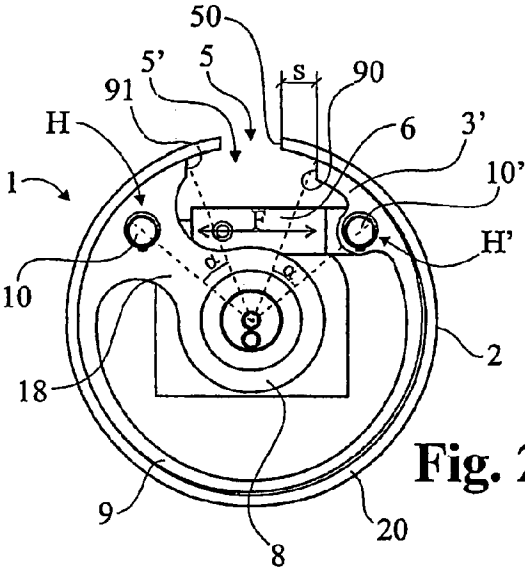
FIG. 2 illustrates a radial cross-section of a reel according to a preferred embodiment.

The use of an inventive reel in a preferred embodiment according to the description in FIG. 2, for unwinding of material, can be divided into three steps. In a first step, the reel is compressed where after a bobbin is placed on the reel 1. Then, the reel 1 is expanded whereby the bobbin will be firmly attached to the reel by contact with the support surface 2 of the reel. In a second step, the wound material is unwounded from the reel 1. In a third step, the reel 1 is compressed whereby any possible support cylinder from the bobbin can be lifted off from the reel.

When using a reel 1 for winding, the reel is equipped with a strip nip 15, diagrammatically shown in FIG. 2. The winding can suitably take place by in a first step attaching the front end of a reelable object in the nip 15, where after the reel is compressed. Thereafter, the reel is rotated at least one revolution about the axis 4, whereby the reelable object is wound onto the reel. Then, the reel is expanded, whereby the reelable object is brought to bear against the support surface 2 of the reel. In a second step, the reelable object is wound onto the reel and in a third step, the reel is compressed, whereby the wound object can be removed from the reel.

The invention claimed is:

1. A reel for winding or unwinding reelable, strip-shaped objects comprising:

a support surface that extends in the main as a cylinder;

a hub arranged to rotate about an axis in order to allow rotation of the support surface about said axis;

an adjusting device arranged to cooperate with the support surface in order thereby to vary the diameter of the support surface, wherein the support surface is arranged at a flexible element consisting essentially of a continuous circumferential piece and that the adjusting device is arranged to affect said support surface to alter its shape, whereby the diameter of the support surface is varied; and at least one support ring provided with an opening, which support ring is arranged internally of the support surface, where the support ring at least partially bears against an internal surface of the flexible element, the support ring comprises at least one elongated shank and the hub, wherein the support ring is arranged to run in a groove on the inside of the flexible element, where the groove is arranged in a plane that is essentially parallel to the direction of rotation of the reel.

2. A reel according to claim 1, wherein said support surface all together constitutes at least 270° of the circumferential extension of said support surface.

3. A reel according to claim 1, wherein said support surface comprises an axial through opening.

4. A reel according to claim 2, wherein said support surface comprises an axial through opening.

5. A reel according to claim 4, wherein said opening has an extension along the circumference of said support surface that is proportional to a diameter variation (D1–D2) of the reel, so that $b=\pi(D1-D2)$.

6. A reel according to claim 3, wherein said opening has an extension along the circumference of said support surface that is proportional to a diameter variation (D1–D2) of the reel, so that $b=\pi(D1-D2)$.

7. A reel according to claim 1, wherein said adjusting device comprises a force exerting device that is arranged to affect the support surface with a force, the component force of which being a chord in an imaginary circle the surface of which coincides with said support surface.

8. A reel according to claim 2, wherein said adjusting device comprises a force exerting device that is arranged to affect the support surface with a force, the component force of which being a chord in an imaginary circle the surface of which coincides with said support surface.

9. A reel according to claim 5, wherein said adjusting device comprises a force exerting device that is arranged to affect the support surface with a force, the component force of which being a chord in an imaginary circle the surface of which coincides with said support surface.

10. A reel according to claim 8, wherein the force exerting device cooperates with at least one engagement means that are connected to said flexible element and where the engagement means are placed internally of said flexible element.

11. A reel according to claim 9, wherein the force exerting device cooperates with at least one engagement means that are connected to said flexible element and where the engagement means are placed internally of said flexible element.

12. A reel according to claim 10, wherein the force exerting device cooperates with said engagement means by at least one pivotal attachment.

13. A reel according to claim 11, wherein the force exerting device cooperates with said engagement means by at least one pivotal attachment.

14. A reel according to claim 1, wherein in a position in which the reel is completely expanded, the support ring has a circumferential extension that is shorter that the circumferential extension of the support surface, and where a distance form the end of one shank to an edge at the opening of the support surface is essentially equal to the extension along the circumference of said support surface.

15. A reel according to claim 1, wherein the strip shaped objects are steel strips.

16. A reel according to claim 1, wherein the support ring preferably is essentially parallel to a radial cross-section of the support surface.

17. A reel according to claim 1, wherein said support ring further comprises engagement means, and that the at least one elongated shank, the hub and the engagement means are connected to each other.

18. A reel according to claim 1, wherein said support ring further comprises engagement means, and that the at least one elongated shank, the hub and the engagement means are integrated.

* * * * *